US005568848A

United States Patent [19]

Liang

[11] Patent Number: 5,568,848

[45] Date of Patent: Oct. 29, 1996

[54] LATERALLY MOVABLE SUITCASE WITH WHEELED, PIVOTABLE LEG

[76] Inventor: Joseph Liang, P.O. Box 1060, Alpine, N.J. 07620

[21] Appl. No.: 270,176

[22] Filed: Jul. 1, 1994

[51] Int. Cl.[6] ..... A45C 5/14; A45C 13/28

[52] U.S. Cl. ..... 190/18 A; 190/18 R; 190/39; 190/115; 280/37; 280/47.2; 280/655.1

[58] Field of Search ..... 190/18 A, 18 R, 190/15.1, 115; 280/32, 47.2, 655, 655.1

[56] References Cited

U.S. PATENT DOCUMENTS

| | | | |
|---|---|---|---|
| Re. 29,036 | 11/1970 | Hager | 190/18 AX |
| 1,081,670 | 12/1913 | James | 190/18 RX |
| 1,099,933 | 6/1914 | Pohrer | 190/18 AX |
| 1,176,876 | 3/1916 | Vartabedian | 190/18 AX |
| 3,178,197 | 4/1965 | Boatner | 280/37 |
| 3,724,617 | 4/1973 | Lawler | 190/18 A |
| 3,850,441 | 11/1974 | Peters et al. | 280/47.2 |
| 3,873,118 | 3/1975 | Takagi | 280/47.2 |
| 4,588,055 | 5/1986 | Chen | 190/18 A |
| 5,044,476 | 9/1991 | Seynhaeve | 190/18 A |
| 5,167,389 | 12/1992 | Reimers | 280/DIG. 6 X |

FOREIGN PATENT DOCUMENTS

| | | | |
|---|---|---|---|
| 187183 | 7/1986 | European Pat. Off. | 190/15.1 |
| 961977 | 5/1950 | France | 190/18 A |
| 1145985 | 11/1957 | France | 190/18 A |
| 839689 | 5/1952 | Germany | 190/18 A |
| 9319636 | 10/1993 | WIPO | 190/18 A |

*Primary Examiner*—Sue A. Weaver
*Attorney, Agent, or Firm*—Cohen, Potani, Lieberman, Pavane

[57] ABSTRACT

An article of wheeled luggage having improved mobility characteristics employs a wheeled pivotable leg operatively coupled to a retractable and extendable handle. The article becomes self-supported in a forwardly-tilted configuration when the user tilts the article and causes the wheeled pivotable leg to swing outwardly from the forward surface of the article. Stable support in the tilted position is provided by at least one rolling member on the bottom surface of the article proximate a forward surface thereof and by at least one rolling member on the base of the pivotable leg. In the tilted configuration, the article has a lower center of gravity and a larger wheelbase or footprint than when the article is standing upright, and is better able to counteract overturning forces.

10 Claims, 2 Drawing Sheets

LATERALLY MOVABLE SUITCASE WITH WHEELED, PIVOTABLE LEG

FIELD OF THE INVENTION

The present invention relates to articles of luggage having rolling means for user-selectable movement on an underlying support surface. More particularly, it relates to articles of luggage employing a pivotable leg structure that permits rolling movement of the luggage in a self-supporting, forwardly tilted orientation.

DESCRIPTION OF THE PRIOR ART

Various articles of luggage have been proposed that include features designed to alleviate the burden of the heavily laden traveler. Such features include, for example, telescoping handles or elongated straps and sets of rollers that enable the traveller to pull the article while walking over a substantially planar surface. As will be readily appreciated by those skilled in the art, the principal objectives of incorporating the aforementioned features into an article of luggage are to provide ease of use, maneuverability and stability to the article while minimizing manufacturing cost and overall weight.

A frequent problem encountered by a user of articles equipped with the aforementioned features is that the article may overturn if a user changes direction abruptly. The tendency to overturn is aggravated by the typically small footprint or narrow wheelbase and/or the lack of an effective way of enabling the user to resist overturning forces. For this reason, some luggage articles position the handle and wheels in such a manner as to permit a tilted orientation as the luggage is pulled. However, although such a configuration provides the user with limited control while maneuvering, the failure to include auxiliary means for supporting the article in a fixable, tilted configuration leaves it to the user to exert the appreciable amount of force required to support the article.

The luggage user may accordingly prefer to assume a plurality of luggage items to a carrier or other movable luggage article so that they may be transported as a single unit. Unfortunately, the presence of these additional strapped-on items may render the movable luggage unstable. In such cases, the user must either support the movable article at all times or allow the forward or rear surface of the article to contact the ground when at rest.

There are still other situations in which it would be desirable to have a self-supporting, movable luggage article. One that readily comes to mind is when a user transacts with an airline agent at an airline ticket counter. The user in such a situation must have his/her hands free so that the user may process various requisite papers, requiring release of the article of luggage and sometimes resulting in the article's falling to the floor.

SUMMARY OF THE INVENTION

It is therefore an object of the present invention to provide an article of luggage having increased mobility and stability, both during movement and while at rest.

It is another object of the invention to provide an article of luggage having features that facilitate stable and controllable movement in a forwardly tilted configuration.

It is a further object of this invention to provide an article of luggage which is lightweight, compact and simple in design, and which is economical to manufacture.

The foregoing and other objects of the present invention are achieved in an article of wheeled luggage having a top surface, a side surface and a bottom surface, a pivotable leg carrying a first rolling means, and a selectively retractable and extendable handle means secured to the side surface. Projecting from the bottom surface and proximate a transverse edge of the bottom surface is a second rolling means. Thus, when the article is tilted about this second rolling means and the pivotable leg is caused to pivot outwardly from the side surface and engage an underlying support surface, the article is self-supporting in a forwardly tilted configuration.

In the forwardly tilted configuration, a user may employ the extendable handle or other handle means to move and steer the tilted article in a selected direction without expending the additional effort otherwise required to continuously support the weight of the article. Furthermore, the provision of a leg assembly pivotable relative to the forward sidewall of the luggage article into a tilted article support position enables the user to secure additional luggage items to the movable article without requiring the user to support the luggage assembly.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE DRAWINGS

In the drawings, wherein like reference numerals denote similar elements throughout the several views.

DETAILED DESCRIPTION OF THE PREFERRED EMBODIMENTS

Figure 1:
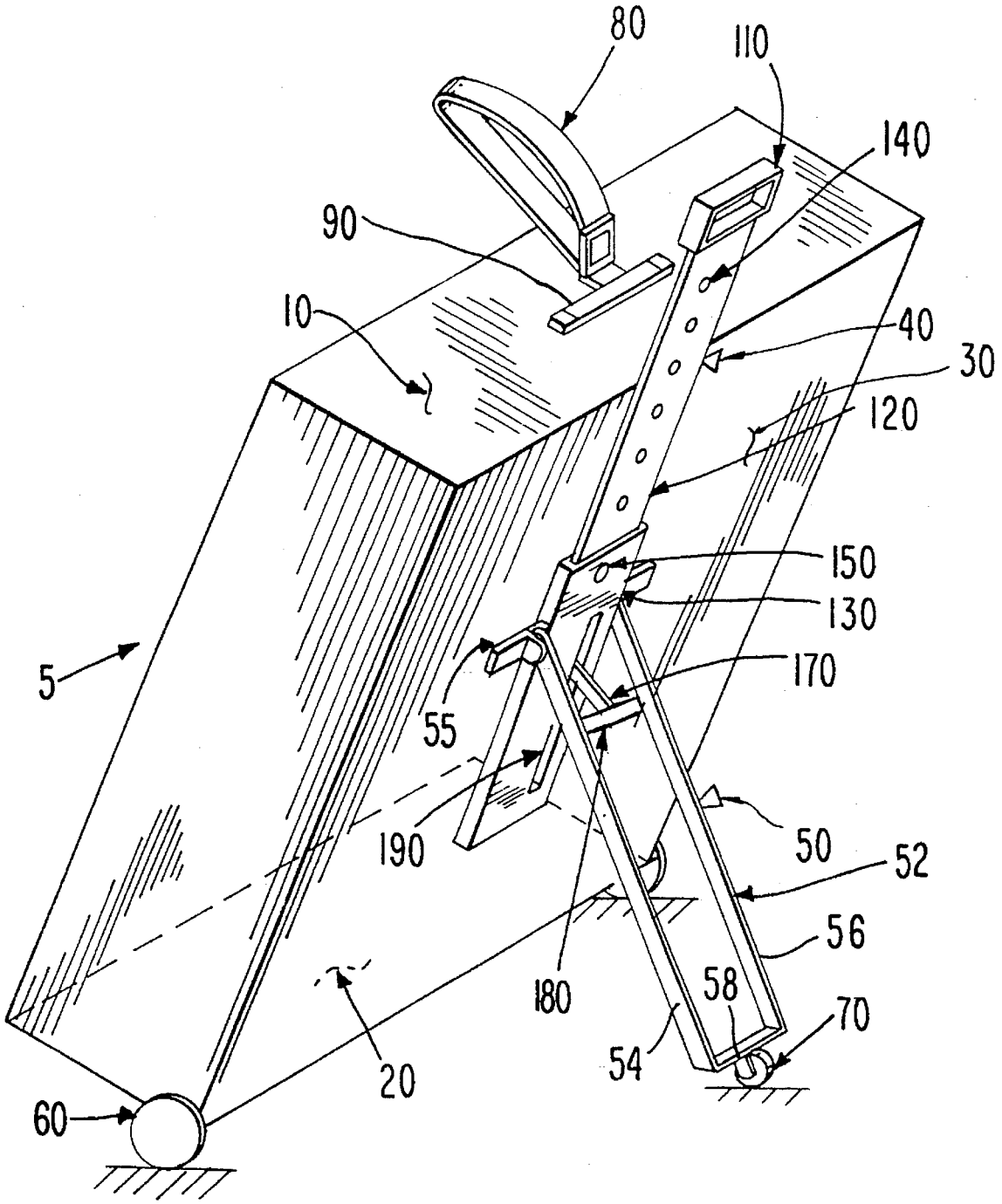
FIG. 1 is a perspective view of an article of luggage constructed in accordance with an illustrative embodiment of the present invention and shown in its self-supported, forwardly-tilted orientation.
Figure 3:
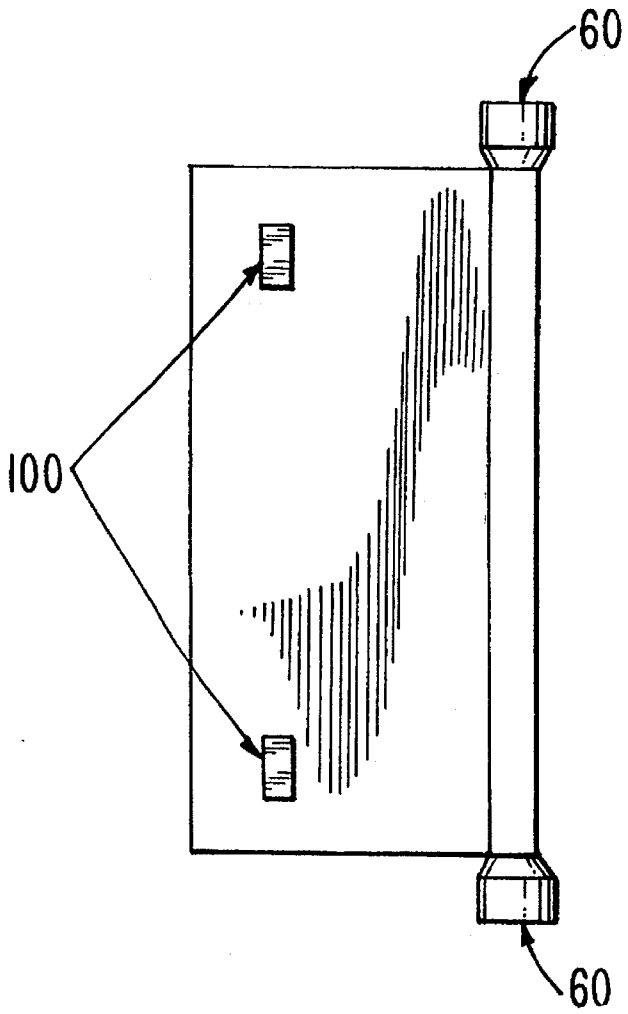
FIG. 3 is a bottom view of the luggage article of FIG. 1 depicting the spatial distribution of the supporting rollers on the bottom surface thereof.

With reference now to FIG. 1, there is illustrated an article of luggage 5 constructed in accordance with a preferred embodiment of the invention. As there shown, article 5 includes a conventional interior storage compartment bounded by a top surface 10, a bottom surface 20, a forward surface 30, a rear surface (not shown) and first and second lateral surfaces (only one of which is shown in FIG. 1 ). Article 5 further includes a retractable handle assembly 40 and a leg structure 50 pivotably secured to the forward surface 30 by an anchor member 55.

As hereinafter described in detail, handle assembly 40 and leg structure 50 are each movable from respective retracted positions (FIG. 2) into their corresponding fully extended positions shown in FIG. 1. If desired, the handle assembly and leg structure may be configured to be independently manipulatable separately and manually between their respective retracted and extended positions. For ease of use, however, it is preferred that the handle assembly 40 and pivotable leg structure 50 be linked so that extension of the handle assembly causes automatic forward pivotal movement of the leg structure, while retraction of the handle assembly similarly returns the leg structure to its retracted, non-supporting position. Linkages suitable for this purpose are well known and, as will be readily appreciated by those skilled in the art with knowledge of this disclosure, the modification or selection of a particular linkage configuration will be influenced by the specific structures employed for the handle assembly 40 and leg structure 50.

In the illustrative embodiment of FIG. 1, handle assembly 40 includes an elongated portion 120 that is slidably received within a channel structure 130 secured to the forward surface 30 of article 5. A graspable handle 110 is secured to the upper end of elongated portion 120. Pivotable leg structure 50 includes an essentially U-shaped member 52 that is pivotably movable relative to forward surface 30 and that includes first and second elongated portions 54, 56 interconnected by a base portion 58. U-shaped member 52 is linked to elongated portion 120 by a linkage member 170. As seen in FIG. 1, linkage member 170 is pivotally connected at one end to a cross member 180 secured to elongated portions 54 and 56 of member 52. At its other end, linkage member 170 is pivotally connected to elongated portion 120 for movement within a vertical slot 190 defined in channel structure 130.

Figure 2:
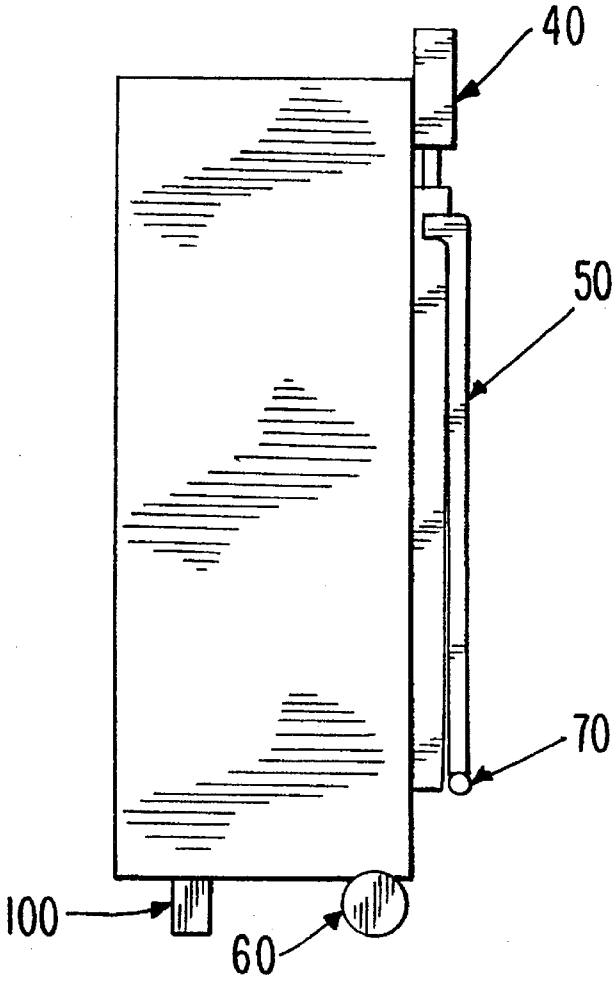
FIG. 2 is a front view of the luggage article of FIG. 1 showing the article in an upright orientation with the handle retracted.

In operation, the handle 110 is gripped and pulled upwardly from the position shown in FIG. 2 into the position shown in FIG. 1. As elongated portion 120 moves upward, linkage member 170 exerts an upward pulling force on cross member 180, thereby causing forward pivoting of U-shaped member 52. Similarly, downward movement of graspable handle 110 from the position shown in FIG. 1 restores the elongated portion 120 and U-shaped member 52 to their fully retracted positions.

The various components of handle structure 40 may be fabricated from any suitably rigid materials such, for example, as aluminum or thermoplastics. Moreover, the length of elongated portion 120 may be made selectively adjustable, as by incorporating a spring detent structure for locking the elongated portion 120 top one or more predetermined vertical positions. In the embodiment depicted in FIG. 1, spring-loaded studs 140 are provided at predetermined, vertically spaced positions along the length of elongated portion 120. The studs 140 are sized for slidable receipt into a capture device such as a cavity disposed on the inwardly facing surface of a release button 150. Release button 150 may be formed of flexible materials such, for example, as rubber-based compounds.

In operation, elongated portion 120 is moved within channel 130 until one of the studs 140 is aligned with the cavity of release button 150. When so aligned, the stud is resiliently urged into the cavity, thereby fixing the position of elongated member 120 and, thus, maintaining graspable handle 110 at a desired position. In this manner, elongated portion 120 may be locked in a fully retracted position, a fully extended position, or one of a plurality of intermediate positions therebetween. To release a stud 140 from engagement with the release button 150—i.e. to readjust the position of graspable handle 110—the user need only depress the release button 150 so that stud 140 is caused to retreat from the cavity of release button 150. While the release button 150 is depressed, elongated portion 120 is free to slide to the next or some other selectable position in the channel 130.

First rolling means 60, for example rollers with a fixed axis of rotation, project from the bottom exterior surface 20 of article 5 proximate a transverse edge thereof. If desired, second rolling means 70, as for example a caster, may be attached to base portion 58 of pivotable U-shaped leg member 52 so that when the article 5 is tilted forwardly with the U-shaped leg member 52 extended, article 5 is self-supporting upon an underlying support surface by first rolling means 60 and second rolling means 70. The arrangement of rolling means 60 and 70 on the bottom surface is best seen in FIG. 1.

Rolling means 60 and 70 provide at least three points of support. Thus, the user may stably steer and move the article 5 with little effort because the article 5 has a substantially enlarged footprint or wheelbase and lowered center of gravity. As a result, the article 5 is more readily capable of resisting overturning forces. In this regard, it should be noted that various modifications may be made to leg structure 50 so that second rolling means 70 may be implemented by a plurality of spaced apart casters or rollers to further enhance the stability of the article 5 during use. For example, the length of the base portion 58 of U-shaped leg member 52 may be increased to accommodate several spaced apart casters. Alternatively, the leg structure may be reconfigured with separate independently pivoting members each having a caster or roller secured thereto.

The embodiment depicted in FIG. 1 also includes a securing means 80 such, for example, as a length adjustable strap and a quick release fastener or coupling coupled to the top surface 10 of article 5 so that users can superpose additional luggage items upon the rear exterior surface of article 5. In its forwardly-tilted configuration, the article 5 may advantageously carry the additional weight of the luggage items through said securing means 80 with little risk of overturning.

It is also contemplated that the securing means 80 may be employed by users to pull the article 5 while the article 5 is in its forwardly-tilted configuration. Furthermore, since the length of securing means 80 is selectively adjustable, users of a range of heights can be accommodated. FIG. 1 further depicts a conventional handle 90 mounted at a location proximate the securing means 80 to facilitate other mobility requirements of a particular user.

As seen in FIG. 2, when the article is standing upright the weight of the article is supported by rest stops 100 and first rolling means 60. Also depicted in FIG. 2 are the retracted states of both the pivotable leg 50 and the handle means 40.

Thus, while there have been shown and described and pointed out fundamental novel features of the invention as applied to a preferred embodiment thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. An article of luggage for rolling movement along an underlying support surface in a user-selectable direction, comprising:

a top surface;

a bottom surface having a transverse edge;

a forward surface connecting said top and bottom surfaces;

first rolling means projecting from said bottom surface and disposed proximate said transverse edge for rolling engagement with an underlying support surface when the article is forwardly tilted relative thereto substantially about said transverse edge;

handle means secured to said forward surface for grasping by a user of the article and having a graspable portion and an elongated portion, said graspable portion being operatively movable between a retracted position and an extended position relative to said forward surface;

an elongated leg structure pivotally mounted to said forward surface for pivotal movement of said leg structure relative to said forward surface between a retracted position and an extended supporting position in which said article, when forwardly tilted substantially about said transverse edge, is simultaneously supported by said extended elongated leg structure and said first rolling means; and linkage means operatively coupling said handle means and said leg structure for synchronizing retraction and extension of said handle means and said leg structure.

2. The article according to claim 1, wherein said elongated leg structure includes a substantially U-shaped member substantially defining parallel elongated portions and a base portion interconnecting the elongated portions of said U-shaped member.

3. The article according to claim 2, further including second rolling means secured to said base portion for supporting said article in conjunction with said first rolling means when said article is in a forwardly-tilted orientation.

4. The article according to claim 1, wherein said handle means and said pivotable leg structure are coupled so that as said graspable portion is pulled upwardly, said pivotable leg structure pivots to its extended position, and when said handle means is pushed downwardly, said pivotable leg structure pivots to its retracted position.

5. The article according to claim 1, wherein said linkage means comprises:

channel means for defining a channel dimensioned and arranged to slidably receive said elongated portion, said channel means being disposed proximate said forward surface and defining a slot therein;

a linkage member having first and second ends, said first end being pivotally connected to the elongated portion of said handle means through said slot and said second end being pivotally coupled to said pivotable leg structure so that motion of said handle means is linked to motion of said pivotable leg structure.

6. The article according to claim 5, wherein said channel means defines an aperture communicating with the channel defined by said channel means and wherein said locking means comprises:

a release button defining a cavity, said release button being disposed within said aperture; and a plurality of resiliently biased members disposed along said elongated portion, said biased members being alignable with said cavity and dimensioned for slidable receipt thereinto, so that when one of said biased members is aligned with said cavity said one biased member is resiliently urged into said release button to thereby lock said elongated portion and graspable portion in a selected position.

7. The article according to claim 1, further comprising:

means for restraining additional luggage items against an exterior surface of the article, said restraining means having an adjustable length to accommodate items of various dimensions.

8. The article according to claim 1, further including means for locking said elongated portion at a selected position relative to said forward surface.

9. The article according to claim 1, wherein said first rolling means comprises at least one roller having a fixed axis of rotation.

10. The article according to claim 1, further including a caster rotatably coupled to said pivotable leg structure.

* * * * *